US006501053B2

(12) United States Patent
Becker et al.

(10) Patent No.: US 6,501,053 B2
(45) Date of Patent: Dec. 31, 2002

(54) CONTROL SYSTEM FOR AN APPLIANCE COOKTOP

(75) Inventors: Theodore A. Becker, Cleveland, TN (US); Mark A. Pickering, Cleveland, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/964,575

(22) Filed: Sep. 28, 2001

(65) Prior Publication Data

US 2002/0014482 A1 Feb. 7, 2002

Related U.S. Application Data

(63) Continuation-in-part of application No. 09/626,388, filed on Jul. 26, 2000, now Pat. No. 6,297,482.

(51) Int. Cl.[7] ..... H05B 1/02; H05B 3/18

(52) U.S. Cl. ..... 219/506

(58) Field of Search ..... 219/476, 479, 219/480, 483, 506, 508, 452.11, 452.12, 460.1, 462.1, 446.1, 445.1; 126/211, 299 D

(56) References Cited

U.S. PATENT DOCUMENTS

D113,275 S 2/1939 Miller
2,233,463 A 3/1941 Wilson
2,632,434 A 3/1953 Pearce
3,313,919 A 4/1967 Richardson et al.
3,409,005 A 11/1968 Field
3,586,825 A * 6/1971 Hurley ..... 126/21 A
3,627,986 A 12/1971 Anderson
3,781,522 A 12/1973 Borom et al.
3,816,704 A 6/1974 Borom et al.
3,819,906 A 6/1974 Gould, Jr.
3,870,861 A 3/1975 Werych
3,886,539 A 5/1975 Gould, Jr.

(List continued on next page.)

*Primary Examiner*—Sang Paik
(74) *Attorney, Agent, or Firm*—Diederiks & Whitelaw, PLC

(57) ABSTRACT

A cooking appliance including a cooktop incorporates a plurality of control element arrays for regulating spaced heating zones, a downdraft venting system that includes a grill provided on the cooktop, and a timing device. In accordance with the most preferred form of the invention, electronic control components are utilized and openings are formed in a ceramic-based face plate portion of the cooktop to accommodate mounting of the electronic control components generally flush with an exposed surface of the face plate portion.

20 Claims, 2 Drawing Sheets

U.S. PATENT DOCUMENTS

D235,606 S 7/1975 Petkwitz
3,936,660 A 2/1976 Blackwood
4,004,130 A 1/1977 Blackwood
4,149,217 A 4/1979 Tucker
4,169,222 A 9/1979 Tucker
4,204,204 A 5/1980 Pitstick
4,341,197 A 7/1982 Butts
D270,806 S 10/1983 Notbohm
D271,269 S 11/1983 Vetter et al.
4,454,501 A 6/1984 Butts
4,501,260 A 2/1985 Grace
4,527,049 A 7/1985 Thomas et al.
4,561,002 A 12/1985 Chiu
4,633,067 A 12/1986 Payne et al.
D295,252 S 4/1988 Mierzwinski
4,816,647 A 3/1989 Payne
4,855,550 A 8/1989 Schultz, Jr.
4,899,028 A 2/1990 Arai et al.
4,921,210 A 5/1990 Hutchison et al.
5,155,338 A 10/1992 Hoffmann
5,190,026 A * 3/1993 Doty ..... 126/299 D
5,221,829 A 6/1993 Yahav et al.
5,279,279 A 1/1994 White
5,321,229 A 6/1994 Holling et al.
5,349,162 A 9/1994 Holling
5,357,079 A 10/1994 Henry et al.
5,357,080 A 10/1994 Vetter et al.
5,374,807 A 12/1994 Yahav et al.
5,378,874 A 1/1995 Holling et al.
5,399,840 A 3/1995 Goeddeke
5,508,495 A 4/1996 Yahav et al.
5,549,100 A 8/1996 Heisner et al.
5,572,205 A 11/1996 Caldwell et al.
5,611,327 A 3/1997 Filho et al.
5,679,273 A 10/1997 Petetin
5,742,031 A * 4/1998 Kelly et al. ..... 126/299 D
5,796,346 A 8/1998 Wash et al.
5,847,364 A 12/1998 White et al.
5,859,410 A 1/1999 White et al.
5,867,111 A 2/1999 Caldwell et al.
5,958,272 A 9/1999 Taplan et al.
5,968,219 A 10/1999 Gille et al.
6,043,461 A 3/2000 Holling et al.
6,050,176 A 4/2000 Schultheis et al.
6,067,980 A 5/2000 Kahlke et al.
6,087,637 A 7/2000 Fischer et al.
6,103,338 A 8/2000 Gille et al.

* cited by examiner

CONTROL SYSTEM FOR AN APPLIANCE COOKTOP

This application represents a continuation-in-part of U.S. patent application Ser. No. 09/626,388 filed Jul. 26, 2000, now U.S. Pat. No. 6,297,482.

BACKGROUND OF THE INVENTION

1. Field of the Invention

The present invention pertains to the art of cooking and, more particularly, to a control system for regulating the activation state of various heating elements, as well as a timer and downdraft fan, associated with a cooktop of a cooking appliance.

2. Discussion of the Prior Art

Both gas and electric cooking appliances are widely available in today's marketplace. The cooktops associated with electric cooking arrangements employ either coiled, electric resistance burner elements which project slightly above the upper surface of the associated cooktop, or smooth cooktops. Smooth cooktops are formed of glass or ceramic-based, i.e., ceramic and glass-ceramic, materials.

Due to material characteristic limitations, care must be taken when forming a ceramic-based cooktop as the material can be subject to cracking and the like when stressed. This potential problem is of particular concern given that the ceramic-based cooktop must be free to flex during use. For at least these reasons, a ceramic-based cooktop will almost invariably be made as a plate extending in a single plane and without any openings. However, it has been proposed, as disclosed in U.S. Pat. No. 5,357,079, to create a bend at a rear section of a cooktop. Although controls for various heating elements are arranged adjacent to the bent zone of the cooktop, the controls are actually carried by a frame upon which the cooktop is supported. The upper surface of a ceramic-based cooktop is generally provided with a grid pattern to diminish the inherent transparent nature of the material. In the '079 patented arrangement, small transparent regions are maintained to provide visual clarity of illuminated displays mounted below the cooktop.

In order to enhance the use and versatility of ceramic-based and other types of cooktops, it would be desirable to enable heating element control devices to be mounted in a convenient, readily available and effective manner to the cooktop. In addition, there exists a need for an efficient operator control system which is unobtrusive to the use of the cooktop, particularly when the controls are located along a front portion of the cooktop. Furthermore, a need exists for a versatile control system which extends beyond regulating heating elements to controlling other devices associated with the overall cooking appliance.

SUMMARY OF THE INVENTION

The present invention is directed to a cooking appliance including a cooktop, adapted to be mounted on a countertop or upon an appliance cabinet, which defines varies spaced heating zones, and a control arrangement for regulating the operation of heating elements arranged in the heating zones. The cooktop also preferably incorporates a downdraft venting system including a grill provided in a generally, laterally centered portion of the cooktop, with suitable controls for the downdraft venting system. Additional controls for a timer unit are also preferably provided. In accordance with the most preferred form of the invention, electronic control components are utilized and openings are formed in the cooktop to accommodate mounting of the electronic control components. Most preferably, the electronic control components are generally flush with an exposed surface of the cooktop to avoid the components being any type of obstruction during use of the cooktop.

Additional objects, features and advantages of the invention will become more fully apparent below from the following description of a preferred embodiment of the invention when taken in conjunction with the drawings wherein like reference numerals refer to corresponding parts in the several views.

DETAILED DESCRIPTION OF THE PREFERRED EMBODIMENT

Figure 1:
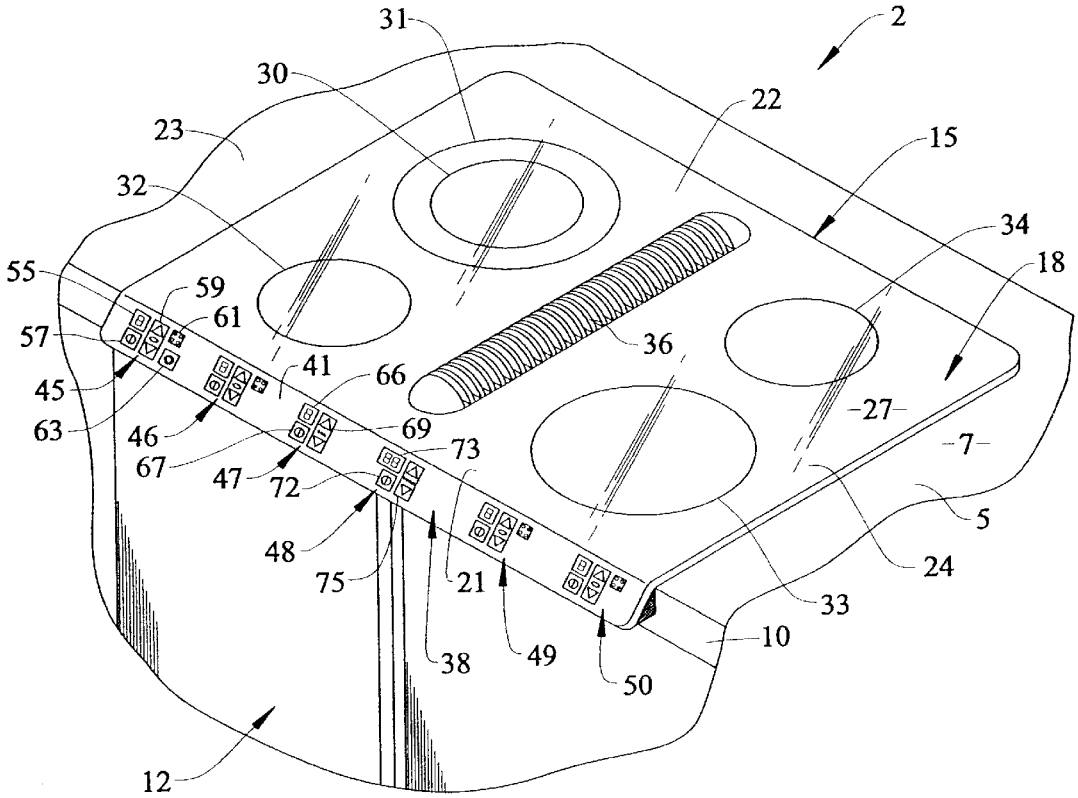
FIG. 1 is a perspective view of a ceramic-based cooktop having an angled front face portion provided with a control system constructed in accordance with the invention mounted upon a countertop.
Figure 2:
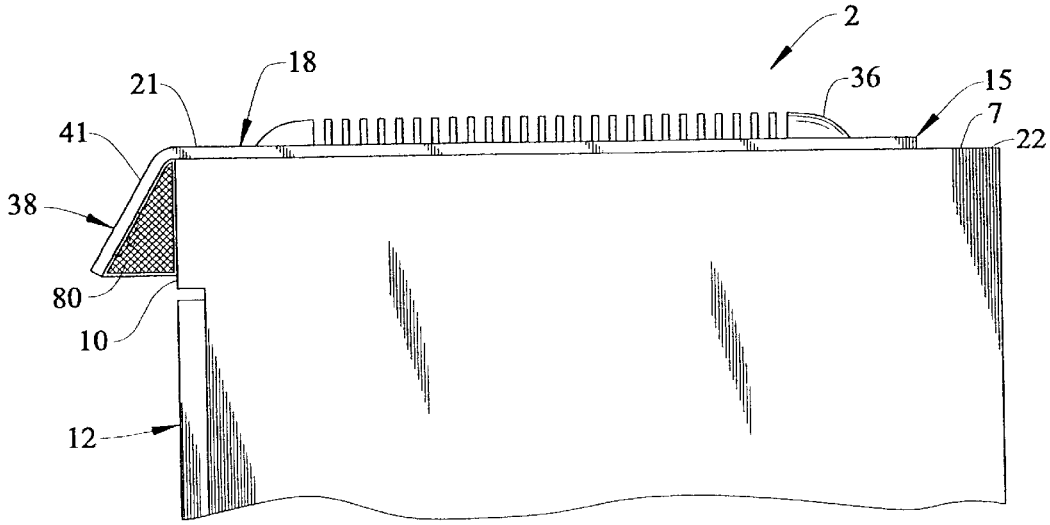
FIG. 2 is a side elevational view of the cooktop of FIG. 1.

With reference to both FIGS. 1 and 2, a kitchen cooking arrangement, generally indicated at 2, includes a countertop 5 having an upper surface 7 which extends in a generally horizontal plane and a front edge portion 10 which is depicted to be generally perpendicular to upper surface 7. Below countertop 5 is illustrated to be cabinetry 12. At this point, it should be noted that countertop 5 could be positioned against a wall within a kitchen or can form part of an island. Kitchen cooking arrangement 2 also incorporates a cooktop 15 that includes a main plate portion 18 which is secured upon upper surface 7 of countertop 5. Main plate portion 18 is generally defined by a frontal section 21, a rear section 22 and side edge sections 23 and 24. Main plate portion 18 has an upper surface 27 which defines various spaced heating element zones 30–34, with heating element zone 30 being concentrically arranged within heating element zone 31.

As shown, in the most preferred embodiment, upper surface 27 constitutes a smooth top-type cooking surface. More specifically, cooktop 15 is made from a ceramic-based material. By referring to cooktop 15 as being made from a ceramic-based material, it is intended to cover various materials including ceramic, glass-ceramic and like materials. Although cooktop 15 preferably includes a smooth cooking surface, heating element zones 30–34 could be defined by coiled resistance-type heating elements or even gas burners extending above upper surface 27. However, a smooth cooking surface is provided in accordance with the preferred invention. Also provided in accordance with the most preferred form of the invention is a downdraft venting arrangement including a grill 36 which, as shown, extends fore-to-aft from frontal section 21 to rear section 22 in a central portion of upper surface 27.

Cooktop 15 also includes a face plate portion 38 that defines a heating element control panel. Face plate portion 38 includes an exposed surface 41 and is formed integral with main plate portion 18 such that the overall cooktop 15 defines a unitary, one-piece and integrally formed member. As clearly shown in these figures, face plate portion 38 extends downwardly and forwardly from main plate portion 18. In a preferred embodiment, cooktop 15 is positioned upon countertop 5 with face plate portion 38 projecting beyond front edge portion 10. In the most preferred form of the invention, face plate portion 38 is angled downwardly from main plate portion 18 in a range of about 45°–60°. That is, main plate portion 18 extends in a first plane which is substantially horizontal and face plate portion 38 extends in a second plane which intersects the first plane of main plate portion 18. In the most preferred form of the invention, these planes intersect at a 60° angle. In other words, exposed surface 41 of face plate portion 38 is preferably located at an angle in the range of 225°–240°, most preferably 240°, from upper surface 27 of main plate portion 18.

Figure 3:
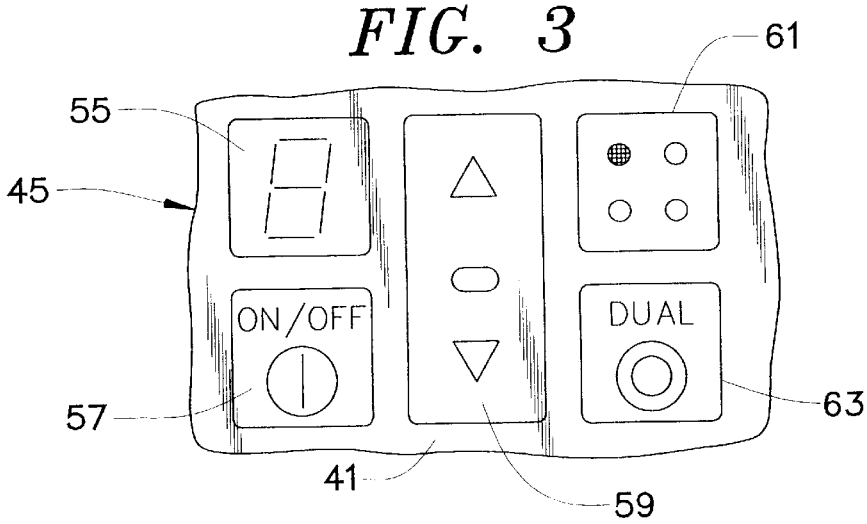
FIG. 3 is an enlarged view of a first set of control elements incorporated in the control system shown in FIG. 1.

With face plate portion 38 extending at an angle to the horizontal and projecting forward of front edge portion 10 of countertop 5, face plate portion 38 can be advantageously utilized as a control panel for the heating elements in zones 30–34. In the most preferred form of the invention, face plate portion 38 is formed with various openings (not separately labeled) which receive electronic control element arrays generally indicated at 45–50. Electronic control element array 45 (see FIGS. 1 and 3) includes an illumination display 55 which preferably constitutes a single, eight-segment LED, a main on/off button 57, a heating element regulating switch 59, a heating element zone indicator 61 and a secondary on/off button 63.

In accordance with the embodiment shown, main on/off button 57 directly controls the activation of heating element zone 30. More specifically, depressing on/off button 57 a single time will activate the heating element associated with zone 30 and pressing on/off button a second time will de-activate the heating element associated with zone 30. Zone indicator 61 preferably provides a reference to the user that electronic control element array 45 pertains to heating element zones 30 and 31. That is, zone indicator 61 takes the form of a box representative of main plate portion 18, with the box including spaced individual circles representing the various heating element zones 30–34. In the most preferred embodiment, zone indicator 61 has simply darkened in the upper leftmost circular area to bring the user's attention to the fact that electronic control element array 45 controls zones 30 and 31. It is also possible in accordance with the present invention to illuminate the particular zone represented area in zone indicator 61, such as with a red diode, to indicate when a heating element zone 30, 31 is activated. Such a diode can be connected to a temperature sensor to remain lit even after the heating element zone 30, 31 is deactivated, with the light being extinguished when the temperature extends below a level at which it is safe to touch that portion of upper surface 27 of cooktop 15. Button 63 controls the activation of the heating element associated with zone 31 in a manner analogous to the operation of button 57. At this point, it should be understood that zone 31 can be activated through button 63 either only following the placement of button 57 in an on condition or button 63 can actually be used to simultaneously activate zones 30 and 31. In any event, it is desired to only permit activation of zone 31 concurrently with zone 30.

Figure 4:
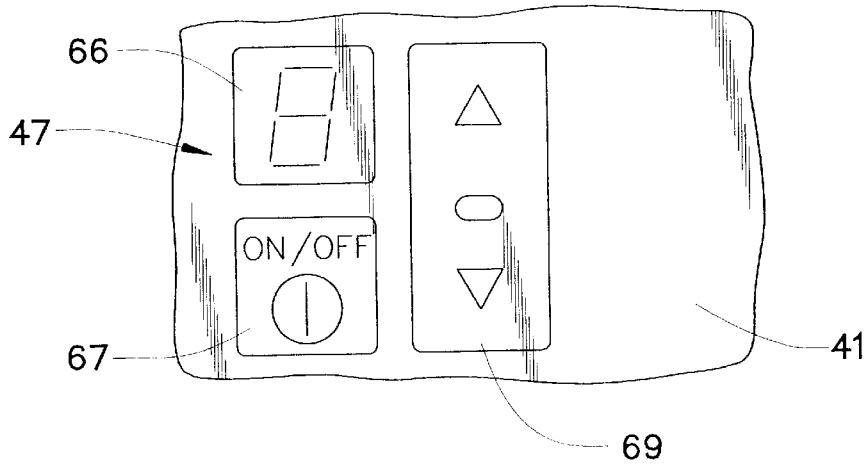
FIG. 4 is an enlarged view of a second set of control elements incorporated in the control system shown in FIG. 1.

Electronic control element arrays 46, 49 and 50 (see FIG. 1) are essentially identically constructed to that of electronic control element array 45, except that control element arrays 46, 49 and 50 lack a corresponding control button 63 and a different portion of zone indicator 61 is highlighted. Since these various control element arrays 46, 49 and 50 are structured and function in a corresponding manner, the description thereof will not be duplicated here. Electronic control element array 47 (see FIGS. 1 and 4) includes a corresponding display 66 which provides a visual indication for the exhaust speed level for the downdraft system associated with grill 36. Therefore, display 66 indicates the fan speed level; power to the downdraft system is controlled by on/off button 67; and the level of operation of downdraft system is controlled by regulating switch 69.

Figure 5:
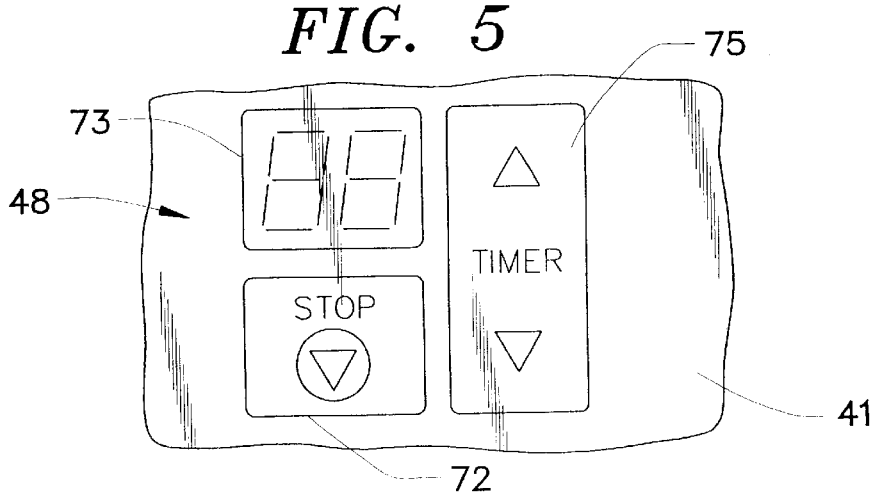
FIG. 5 is an enlarged view of a third set of control elements incorporated in the control system shown in FIG. 1.

Electronic control element array 48 (see FIGS. 1 and 5) is provided to establish a timer control in connection with cooktop 15. Therefore, control element array 48 includes a timer on/off button 72, a multi-digit display 73 and a timer regulator switch 75 which can be used to toggle up and down the display. Although not shown, this overall timer arrangement would be linked to an audible signaling device. In fact, all of the electronic control element arrays 45–50 are linked to a main controller (not shown) used for regulating the operation of cooktop 15. Since the use of such a controller is considered well within one of ordinary skill in the art, details thereof are not provided here.

Based on the above, it should be readily apparent that the cooktop 15 of the present invention provides for an enhanced control panel arrangement for a user while maintaining the integrity of the overall cooktop. That is, face plate portion 38 supports the control components necessary to operate cooktop 15 in more conveniently located positions versus the more conventional arrangement wherein separate knobs would be provided upon countertop 5 adjacent cooktop 15. Of course, it should be realized that, although electronic control element arrays 45–50 are utilized in accordance with the preferred embodiment of a ceramic based cooktop 15 having angled face plate portion 38, control element arrays 45–50 in accordance with the invention could be employed in a wide range of cooktops and also located in various different locations without departing from the invention. In the embodiment shown, the extension of face plate portion 38 beyond front edge portion 10 of countertop 5 enables cooktop 15 to be readily utilized in connection with countertops positioned against a wall and also kitchen island arrangements, while providing an advantageous clearance for the routing of wires or the like. In the preferred form of the invention, one or more covers, such as wire cover 80, is provided for containment and aesthetic purposes. Of course, the style and materials used in connection with cover 80 can vary in accordance with the invention. In the most preferred form, cover 80 actually extends across cooktop 15 behind face plate portion 38 to further block access to the electronic control components and associated wiring. Given the positioning of the face plate portion 38, electronic control array elements 45–50 are generally isolated from the main flexing of main plate portion 18 during operation of cooktop 15 and it has been found that this construction enables face plate portion 38 to be formed with multiple apertures which will not result in fatigue failure.

Due to the unitary construction and smooth nature of electronic control element arrays 45–50, cleaning of both surfaces 27 and 41 can be readily performed. To this end, control elements arrays 45–50 can incorporate clear, transparent plastic cover or film members (not labeled but indicated in FIGS. 3–5) which extend across an entire array of elements or individual transparent members for the various buttons. In any event, although the invention has been described with respect to a preferred embodiment, it should be recognized that various changes and/or modifications can be made without departing from the spirit of the invention. For instance, the particular construction of cooktop 15 and both the arrangement and mounting of electronic control element arrays 45–50 can be altered in accordance with the overall invention. Instead, the invention is only intended to be limited by the scope of the following claims.

We claim:

1. A cooking appliance comprising:

a cooktop having an upper exposed surface;

a plurality of heating element zones defined at spaced locations about the upper exposed surface of the cooktop; and a plurality of electronic control element arrays, each of said control element arrays being associated with a respective one of the heating element zones and incorporating a plurality of separate and distinct control elements including a toggle element and display element, with the toggle element being adapted to be manually engaged to selectively raise or lower a heat output, which is indicated on the display element, for the respective one of the heating element zones, each of the plurality of control elements of the control element arrays being mounted to the cooktop substantially flush with the upper exposed surface.

2. The cooking appliance according to claim 1, wherein the cooktop is formed of ceramic and includes a main plate portion and a face plate portion, said plurality of electronic control element arrays being positioned along the face plate portion.

3. The cooking appliance according to claim 2, wherein the face plate portion is bent relative to the main plate portion.

4. The cooking appliance according to claim 1, wherein each of the control element arrays includes a separate ON/OFF button for the respective one of the heating element zones.

5. The cooking appliance according to claim 4, wherein each of the control element arrays further includes a zone indicator which provides a reference to a user of the cooking appliance which one of the control element arrays pertains to a particular one of the plurality of heating zones.

6. The cooking appliance according to claim 4, wherein at least one of the control element arrays further includes a button used to control an activation state of concentrically arranged ones of the plurality of heating element zones.

7. The cooking appliance according to claim 1, further comprising:

a downdraft system including a grill, arranged atop the upper exposed surface and outside the spaced heating element zones; and an additional control element array for controlling an operational state of the downdraft system.

8. The cooking appliance according to claim 7, wherein the additional control element array includes an element for manually altering the operational speed of the downdraft system and a downdraft display element for indicating the operational speed.

9. The cooking appliance according to claim 8, wherein the downdraft display element constitutes a single-digit display.

10. The cooking appliance according to claim 1, further comprising: a timer control element array including an element for manually setting a timer unit and a multi-digit display element for indicating a set time.

11. The cooking appliance according to claim 10, further comprising:

a stop button for terminating a timing operation set for the timer unit.

12. The cooking appliance according to claim 4, further comprising:

a downdraft system including a grill, arranged atop the upper exposed surface and outside the spaced heating element zones; and an additional control element array for controlling an operational state of the downdraft system.

13. The cooking appliance according to claim 12, further comprising:

a timer control element array including an element for manually setting a timer unit and a multi-digit display element for indicating a set time.

14. A cooking appliance comprising:

a cooktop having an upper exposed surface;

a plurality of heating element zones defined at spaced locations about the upper exposed surface of the cooktop;

a downdraft system including a grill, positioned atop the cooktop, outside the spaced heating element zones;

a timer unit adapted for use in connection with cooking on the cooktop; and a plurality of electronic control element arrays arranged on the cooktop, a first one of said control element arrays being associated with the downdraft system, a second one of said control element arrays being adapted to control the timer unit, and remaining ones of the plurality of electronic being associated with respective ones of the heating element zones.

15. The cooking appliance according to claim 14, wherein each of the plurality of control element arrays including a toggle element and a display element, with the toggle element being adapted to be manually engaged to selectively raise or lower a desired setting level which is indicated on the display element.

16. The cooking appliance according to claim 15, wherein each display element constitutes a seven segment LED.

17. The cooking appliance according to claim 15, wherein each of the control element arrays is mounted to the cooktop substantially flush with the upper exposed surface.

18. The cooking appliance according to claim 14, wherein each of the control element arrays includes a separate ON/OFF button.

19. The cooking appliance according to claim 14, wherein each of the remaining control element arrays further includes a zone indicator which provides a reference to a user of the cooking appliance which one of the remaining control element arrays pertains to a particular one of the plurality of heating zones.

20. The cooking appliance according to claim 14, wherein at least one of the remaining control element arrays further includes a button used to control an activation state of concentrically arranged ones of the plurality of heating element zones.

* * * * *